United States Patent [19]

Ebel et al.

[11] 4,135,134

[45] Jan. 16, 1979

[54] ELECTRIC WIRING SWITCH, ESPECIALLY A LINE PROTECTION SWITCH WITH A FAULT-CURRENT CIRCUIT BREAKER

[75] Inventors: Herbert Ebel, Eppelheim; Rolf Goehle, Leimen; Volker Schmitt, Bammental, all of Germany

[73] Assignee: Brown, Boveri & Cie Aktiengesellschaft, Mannheim-Käfertal, Germany

[21] Appl. No.: 787,322

[22] Filed: Apr. 14, 1977

[30] Foreign Application Priority Data

Apr. 14, 1976 [DE] Fed. Rep. of Germany ..... 2616554

[51] Int. Cl.[2] ..... H01H 83/00; H01H 9/20

[52] U.S. Cl. ..... 335/20; 335/174

[58] Field of Search ..... 335/20, 174, 170, 175, 335/18, 164

[56] References Cited

U.S. PATENT DOCUMENTS

| | | | |
|---|---|---|---|
| 2,217,462 | 10/1940 | Willmann | 335/175 |
| 2,875,294 | 2/1959 | Schleicher | 335/175 |
| 4,001,652 | 1/1977 | Klein et al. | 335/18 |
| 4,048,599 | 9/1977 | Groth | 335/20 |
| 4,066,990 | 1/1978 | Csutor | 335/174 |

FOREIGN PATENT DOCUMENTS

| | | | |
|---|---|---|---|
| 636461 | 3/1962 | Italy | 335/174 |

*Primary Examiner*—Harold Broome

*Attorney, Agent, or Firm*—Herbert L. Lerner

[57] ABSTRACT

An electric wiring switch having an electromagnetic open-circuit shunt tripping device with a magnet armature that, when the tripping device is tripped, acts upon a latching shaft to release a latch upon the ocurrence of a fault current in an electrical circuit wherein the switch is connectible, and also having an indicating device lastingly indicating the tripping of the open circuit shunt tripping device, an operating button displaceable between a first position thereof wherein the switch is in an "on" condition and the operating button is spring loaded, and a second position thereof wherein the switch is in an "off" condition and the operating button is released from the spring loading, the operating button being formed with projection means extending therefrom which, in the "on" condition of the switch, are engaged behind corresponding extension means extending from the latching shaft for firmly retaining the operating button in the first position thereof, and which, in the "off" condition of the switch, after the operating button is in the second position thereof, are engaged with the extension means of firmly retaining the latching shaft in a released position thereof which is assumed thereby when the tripping device is tripped.

7 Claims, 6 Drawing Figures

ELECTRIC WIRING SWITCH, ESPECIALLY A LINE PROTECTION SWITCH WITH A FAULT-CURRENT CIRCUIT BREAKER

The invention relates to an electric wiring switch, especially a line protection switch with a fault-current circuit breaker, having an electromagnetic open-circuit shunt tripping device with a magnet armature that is constructed as a plunger-type impact armature which acts upon a latching shaft to release a latch upon the occurrence of a fault current; and an indicating device lastingly indicating the tripping of the open-circuit shunt tripping device.

Electric wiring switches, especially line protection switches or circuit breakers with their own indicating device, have become known heretofore. They have a visual signal; and, in addition, the switch handle has a middle position or setting marked "trip". Upon actuating the switch handle of the latch into the "off" position, the visual signal disappears, whereas upon the occurrence of an overcurrent trip, the visual signal does not appear at all and the switch handle goes only into the "trip" position.

It would be advantageous, however, if resetting would have to be effected by a special switching movement because, in this manner, the operator would be more distinctly aware of the fault current tripping, and the necessity for performing specific repair work on the electrical installation protected by the fault current circuit breaker is brought to his attention.

It is accordingly an object of the invention to provide an electric wiring switch of the foregoing general type which is operable overall with fewer parts and is therefore less costly and also less trouble-prone and consequently less expensive to operate.

With the foregoing and other objects in view, there is provided, in accordance with the invention, in an electric wiring switch having an electromagnetic open-circuit shunt tripping device with a magnet armature that, when the tripping device is tripped, acts upon a latching shaft to release a latch upon the occurrence of a fault current in an electrical circuit wherein the switch is connectible, and also having an indicating device lastingly indicating the tripping of the open circuit shunt tripping device, an operating button displaceable between a first position thereof wherein the switch is in an "on" condition and the operating button is spring loaded, and a second position thereof wherein the switch is in an "off" condition and the operating button is released from the spring loading, the operating button being formed with projection means extending therefrom which, in the "on" condition of the switch, are engaged behind corresponding extension means extending from the latching shaft for firmly retaining the operating button in the first position thereof, and which, in the "off" condition of the switch, after the operating button is in the second position thereof are engaged with the extension means for firmly retaining the latching shaft in a released position thereof which is assumed thereby when the tripping device is tripped.

In accordance with another feature of the invention, the magnet armature is actuatable and movable in a given direction, and the operating button is disposed between a pair of mutually spaced plates and is displaceable relative to the plates and between the first and second position thereof in a direction transverse to the given direction.

In accordance with a further feature of the invention, the plates are formed with slots extending in direction of displacement of the operating button, and including guide cams formed on opposite sides of the operating button and guidingly received in the respective slots.

In accordance with an added feature of the invention, the latching shaft is formed with rigid first and second arms, and the extension means comprise a first extension on the first arm and a second extension on the second arm, and the projection means of the operating button comprise a first projection cooperatively engageable with the first extension for retaining the operating button in the first position thereof, and a second projection cooperatively engageable with the second extension for retaining the latching shaft in the released position thereof in tripped condition of the tripping device.

In accordance with an additional feature of the invention, the first and second arms of the latching shaft are mutually separated by a space having a given width, and the magnet armature has an axial elongation slidably extending through the space between the first and second arms and has a magnet armature disk secured to the free end of the axial elongation, the axial elongation having a diameter approximately equal to the given width of the space, and the magnet armature disk having a diameter greater than the given width of the space.

In accordance with yet another feature of the invention, the axial elongation of the magnet armature is formed with a collar at a distance from the free end thereof, the collar having a diameter greater than the width of the space between the first and second arms so that, in the tripped condition of the tripping device, the latching shaft is positively retained between the collar and the second projection of the operative button that is cooperatively engageable with the second extension of the latching shaft.

In accordance with a concomitant feature of the invention, the second projection of the operating button is formed with a beveled surface cooperatively engageable with the second extension of the latching shaft during a minimally brief tripping of the tripping device whereby the spring-loaded operating button is slidable with the beveled surface thereof on the second extension under the action of the spring loading so as to bring the latching shaft into the released position thereof.

Other features which are considered as characteristic for the invention are set forth in the appended claims.

Although the invention is illustrated and described herein as embodied in an electric wiring switch, especially a line protection switch with a fault-current circuit breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
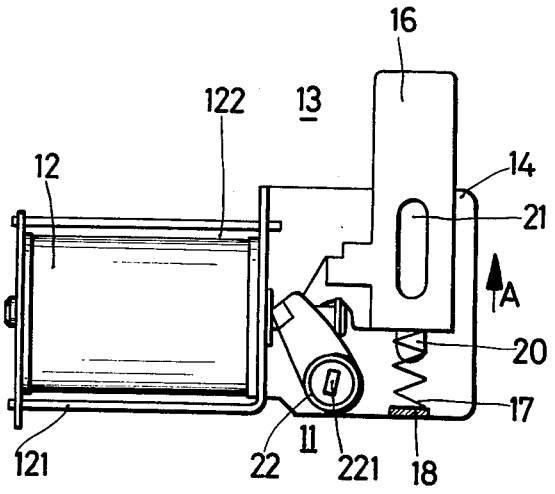
FIG. 1 is a diagrammatic side elevational view of a magnet armature system and a trip indicating device according to the invention.
Figure 2:
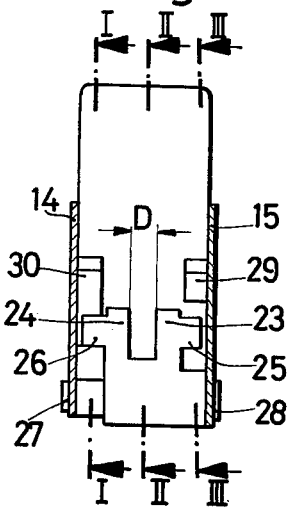
FIG. 2 is a front elevational view of FIG. 1 showing only the indicating device with the operating button therefor.
Figure 6:
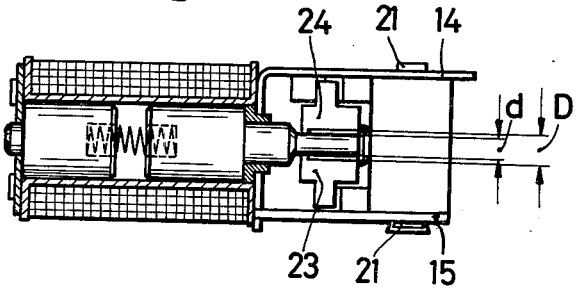
FIG. 6 is a top plan view of FIG. 1 with the coil form thereof cut open.

Referring now to the figures of the drawing, the tripping device of the invention shown and identified in the entirety thereof by the reference numeral 11 is built into a line protection switch with a fault-current circuit breaker. The fault-current circuit breaker is an electronic circuit device responsive to a fault or ground current and thereupon releasing or transmitting an electrical signal. Such an electronic circuit is described, for example, in a prospectus of the firm Cutler-Hammer of Milwaukee, Wis. b 53201, and is sold by this firm under the name Safetyguard GFCI. The tripping device or tripping unit, is provided with an indicating device formed of an electromagnet armature system 12 shown in greater detail in FIGS. 4 and 6. The tripping device further has an indicating and resetting device identified as a whole in FIG. 1 by reference numeral 13. This tripping and resetting device 13 has an operating or actuating button 16 which is mounted and guided between two flat plates 14 and 15 (FIGS. 2 and 6) which is spring-loaded or biased by a spring 17 in direction of the arrow A. This spring 17 is braced, on the one hand, against a cross bar 18 extending between the two flat plates 14 and 15 and, on the other hand, within a blind bore 19 formed in the operating button 16, the spring 17 being guided inside the blind bore 19. Laterally on the operating button 16, guide cams or bosses 21 are provided, which engage in elongatd holes or slots 20 formed in the flat plates 14 and 15 and thus guide the operating button 16. Of the two elongated holes 20, only the enlongated hole 20 formed in the flat plate 14 is shown in FIG. 1. In FIG. 6, however, the lateral guide cams or bosses 21 are visible laterally projecting beyond the flat plates 14 and 15. Also guided within the space between the two flat plates 14 and 15 is a latching shaft 22 which, as shown in FIG. 2, for example, has a first arm 23 and a second arm 24. At the first arm 23, there is a first extension 25 and at the second arm 24, a second extension 26. The latching shaft 22 is guided by means of journals 27 and 28 in the flat plates 14 and 15.

Figure 3:
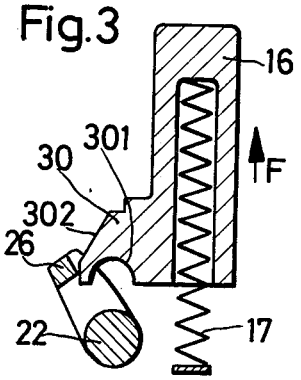
FIG. 3 is a cross-sectional view of FIG. 2 taken along the line I—I in direction of the arrows.
Figure 5:
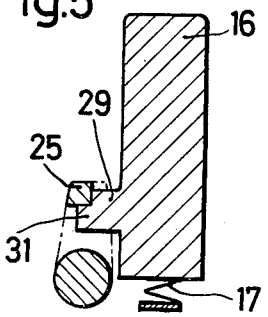
FIG. 5 is a cross-sectional view of FIG. 2 taken along the line III—III in direction of the arrows.

In direction toward the coil device or the electromagnet armature system 12, there are provided on the operating or actuating button 16, a first projection 29 and a second projection 30. The second projection 30 is hook-shaped and cooperates with the second extension 26 at the latching shaft 22, as shown in FIG. 3; the first projection 29 has a step-shaped extension 31 which cooperates with the first extension 25, as shown in FIG. 5; in the depressed or pressed-in condition, the projection 29 engages behind the first extension 25; in this manner, the operating or actuating button 16 is held in the "on" position against the pressure of the spring 17. Likewise, the second projection 30 engages behind the second extension 26, so that a uniform support of the operating or actuating button 16 is ensured.

Figure 4:
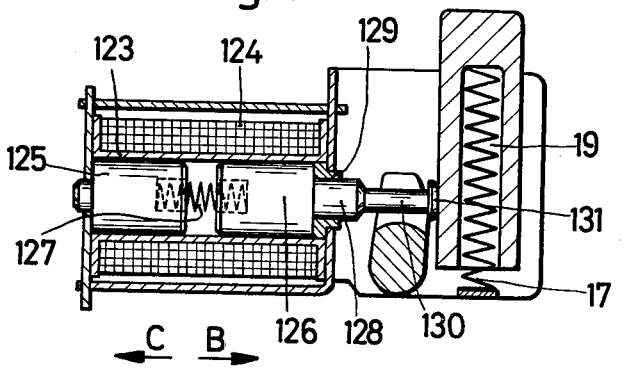
FIG. 4 is a cross-sectional view of FIG. 2 taken along the line II—II in direction of the arrows.

The coil device or the magnet armature system 12 has a magnetic yoke 121 with an iron return path 122; inside the magnetic yoke 121, a coil form 123 is disposed around which a coil 124 is wound. A magnet core 125 is fixedly received within the coil form 123, while a magnet armature 126 is axially displaceably mounted therein. Between the magnet core 125 and the magnet armature 126, a compression spring 127 is disposed and biases the magnet armature 126 in direction of the arrow B (FIG. 4). The magnet armature 126 is continued to the right-hand side, in FIG. 4, as a magnet armature shaft 128 which is guided, at the magnetic yoke 121, within a bushing 129 serving as a guide member. The diameter of the magnet armature shank or shaft 128 changes at the free end of the latter, becoming smaller thereat. This reduced-diameter section of the shaft 128 is identified by the reference numeral 130. At the free end thereof, the reduced-diameter shaft section 130 ends in a magnet armature disk 131. As is apparent in FIG. 6, the distance D between the two arms 23 and 24 is greater than the diameter d of the shaft section 130; and the diameter of the magnet armature disk 131 is greater than the distance D between the two arms 23 and 24.

As can be concluded from FIG. 3, the projection 30 which firmly holds the latching shaft 22 in tripped position thereof, is formed with a groove or notch 301 corresponding to the shape of the shaft 22, so that, in the depressed or pressed-in condition of the operating button 16, the latter is not blocked from the latch shaft 22 by the projection 30.

The operation of the device according to the invention is as follows:

FIG. 4 shows the open-circuit shunt tripping device in the "on" condition i.e. the magnet armature 126 is pressed or biased by the spring 127 in direction of the arrow B; this position indicates the "on" position. As shown in FIG. 5, the operating or actuating button 16 is held fast by the extension 25. Likewise, the extension 26 firmly holds the projections 30. If a fault-current then appears, the non-illustrated electronic circuit device responds and delivers a signal to the magnetic tripping device or trip release. Thereupon, the magnet armature 126 moves in direction of the arrow C due to the magnetic force exerted thereon.

The latching shaft 22 is rotated counterclockwise, as viewed in FIG. 1, due to the entrainment thereof by the magnet armature disk 131; by means of a slot 221 formed in the latching shaft 22 and into which a coupling member is insertable, the counterclockwise motion is transmitted to a non-illustrated switch lock having a latching location. This switch lock opens a non-illustrated movable contact lever. Due to the motion of the magnet armature 126 in direction of the arrow C, the latching shaft 22 rotates into the position thereof shown in FIG. 3. Acted upon by the pressure of the spring 17, the operating or actuating button 16 is impelled in direction of the arrow F, the projection 30 coming into engagement with the extension 26 and preventing the latching shaft 22 from returning, as shown in FIG. 3, to the "on" position thereof under the pressure or bias of a non-illustrated spring.

The position of the operating or actuating button 16 shown in FIGS. 3 and 5 respectively indicate the tripped and the "on" position thereof. The coupled protective switch or circuit breaker can be reclosed only if the operating button is shifted into the "on" position of FIG. 5 in a direction opposite to that of the arrow F (FIG. 3); the obstacle presented by the projection 30, which prevents the latching shaft 22 from turning back, is only then removed.

It is, of course, possible to provide an indicating and actuating device according to the invention also for short-circuit tripping devices. For this purpose, it is necessary merely to construct the operating or actuating button in bifurcated form, for example, so that the magnet armature shaft or shank 130, which is then lengthened, of course, extends through the bifurcated button, between the legs thereof, to a movable contact lever. Nothing is changed then in the basic disposition of the projections 29 and 30 on the operating or actuating button 16 or of the arms 23 and 24 with the respective extensions 25 and 26 thereof at the latching shaft 22.

It should be noted additionally that a bevel 302 is provided on the projection 301 which has the function of bringing the latching shaft 22 completely into the released position i.e. the position thereof when the tripping device has been tripped, if the tripping device has only responded very briefly and the operating or actuating button 16 is not yet completely in the released position thereof. Then, the latching shaft 22 is brought by the spring 17 indirectly into the tripped position due to the bevelled surface 302 which acts upon the extension 26 to turn the latching shaft 22 until it engages a collar 132 provided on the magnet armature shaft 128.

A main advantage attained with the invention is that virtually no additional parts are needed. A latching shaft, with which the magnet armature engages, is present in any conventional wiring switch, especially a line protection switch or circuit breaker; likewise, an operating button is always provided in such a switch so that additional structural parts are not required. It is merely necessary, therefore, to provide the latching shaft with arms and extensions and the operating button with corresponding projections which cooperate with the extensions.

There are claimed:

1. Electromagnetic operating current tripping device for connection to an electric wiring switch in a circuit, comprising a magnet armature movable upon the occurrence of a fault current in the circuit, a latching shaft movable into an engaged position by said magnet armature as the magnet armature moves, means disposed on said latching shaft for actuating the switch when said latching shaft is moved, and a push button lastingly indicating the tripping of the tripping device, said push button having projection means and being displaceable between a first "on" spring-loaded position thereof and a second tripped "off" position released from the spring loading, said latching shaft having extension means, said projection means being engageable by said extension means in said "on" position before said latching shaft has been moved into said engaged position by said magnet armature, so as to lock said push button in said "on" position, said extension means being engageable by said projection means in said "off" position after said latching shaft has been moved into said engaged position by said magnet armature, so as to firmly lock said latching shaft in said engaged position.

2. Electric wiring switch according to claim 1 wherein the magnet armature is actuatable and movable in a given direction and said operating button is disposed between a pair of mutually spaced plates and is displaceable relative to said plates and between said first and second positions thereof in a direction transverse to said given direction.

3. Electric wiring switch according to claim 2 wherein said plates are formed with slots extending in direction of displacement of said operating button, and including guide cams formed on opposite sides of said operating button and guidingly received in the respective slots.

4. Electric wiring switch according to claim 1 wherein the latching shaft is formed with rigid first and second arms, and said extension means comprise a first extension on said first arm and a second extension on said second arm, and wherein said projection means of said operating button comprise a first projection cooperatively engageable with said first extension for retaining said operating button in said first position thereof, and a second projection cooperatively engageable with said second extension for retaining the latching shaft in said released position thereof in tripped condition of the tripping device.

5. Electric wiring switch according to claim 4 wherein said second projection of said operating button is formed with a beveled surface cooperatively engageable with said second extension of the latching shaft during a minimally brief tripping of the tripping device whereby the spring-loaded operating button is slidable with said beveled surface thereof on said second extension under the action of the spring loading so as to bring the latching shaft into said released position thereof.

6. Electric wiring switch according to claim 4 wherein said first and second arms of the latching shaft are mutually separated by a space having a given width, and the magnet armature has an axial elongation slidably extending through said space between said first and second arms and has a magnet armature disk secured to the free end of said axial elongation, said axial elongation having a diameter approximately equal to said given width of said space, and said magnet armature disk having a diameter greater than said given width of said space.

7. Electric wiring switch according to claim 6 wherein said axial elongation of said magnet armature is formed with a collar at a distance from said free end thereof, said collar having a diameter greater than said width of said space between said first and second arms so that, in the tripped condition of the tripping device, the latching shaft is positively retained between said collar and said second projection of said operating button that is cooperatively engageable with said second extension of the latching shaft.

* * * * *